US005373710A

United States Patent [19]

Roth

[11] Patent Number: 5,373,710

[45] Date of Patent: Dec. 20, 1994

[54] NEEDLE ARRANGEMENT FOR WARP KNITTING MACHINE

[75] Inventor: Josef Roth, Seligenstadt, Germany

[73] Assignee: Karl Mayer Textilmaschinenfabrik GmbH, Obertshausen, Germany

[21] Appl. No.: 144,149

[22] Filed: Oct. 27, 1993

[30] Foreign Application Priority Data

Nov. 3, 1992 [DE] Germany ..... 4237084

[51] Int. Cl.[5] ..... D04B 27/06

[52] U.S. Cl. ..... 66/114; 66/123

[58] Field of Search ..... 163/2, 3; 66/114, 120, 66/121, 122, 123, 119

[56] References Cited

U.S. PATENT DOCUMENTS

| | | | |
|---|---|---|---|
| 601,281 | 3/1898 | Salisbury | 661/123 X |
| 793,556 | 6/1905 | Wilson et al. | 66/114 |
| 834,598 | 10/1906 | Wiener | 66/213 X |
| 1,326,555 | 12/1919 | Wilkins | 66/114 |
| 1,916,676 | 7/1933 | Lange . | |
| 1,968,162 | 7/1934 | Nebel | 66/114 |
| 3,584,480 | 6/1971 | Zwingerberger | 66/114 |
| 4,643,004 | 2/1987 | Wunner | 66/120 X |

FOREIGN PATENT DOCUMENTS 68112618 12/1968 Germany .

*Primary Examiner*—Clifford D. Crowder
*Assistant Examiner*—John J. Calvert
*Attorney, Agent, or Firm*—Omri M. Behr; Matthew J. McDonald

[57] ABSTRACT

A plurality of warp knitting machine needles are aligned in a parallel array in a like plurality of needle bar grooves. The needles each have a striker detent projection which mates with an abutment surface of the bar at the groove. The striker projection forms a key which is shaped to torque the needle against the groove in response to a force applied to a force transfer projection extending from the needle on a side opposite the striker projection. A convex tensioning device is between the force transfer projection and the bar and when compressed by a screw threaded to the bar spreads the device and forces the needle into the groove. The striker and the force transfer projection are axially aligned at the same or different needle shaft positions in different embodiments. A collar on the screw between the device and bar limits the maximum force applied to the needle.

14 Claims, 3 Drawing Sheets

11
12
6
8
10
16
17
7
9
15
20
14
19
23
13
4
21
1
22
24
3
18
2
5

NEEDLE ARRANGEMENT FOR WARP KNITTING MACHINE

The present invention relates to a warp knitting machine needle system including a needle for use therewith in which system the needle shafts are located in corresponding parallel grooves in a needle bar wherein the needles are pressed into the grooves by tensile loads, the needles on a side facing the grooves including a detent.

In a known arrangement of this type (German document DE-GM 7113944) the needles have straight shafts each taken up by a groove, the shaft having an angled end at a foot thereof, which end engages and grips a transverse depression in the needle bar. A cover plate coated on the inside with an adhesive material covers the groove and holds the needle shaft in the base of the groove. A synthetic film material is between the cover plate and the needle shaft.

In this construction, a play free axial fixed positioning of the needle is only possible when substantial forces act against the base of the needle groove so that friction prevents axial needle displacement. The forces required to obtain an effective fixation of the needles is so great that the cover plate and/or needle bar are deformed unless constructed in a relatively large and heavy manner. This deformation has, inter alia, certain undesirable consequences, e.g., the needle bar stroke must be increased such that the danger of interference between the needles and needle guides exists and with slider needles, the slider slides along the needle heating the needle due to friction of the sliding action.

A further disadvantage of the known construction is that the heat, generated during operation in the needle vicinities can only be removed on one side of the bar, since the film of synthetic material inhibits the heat transfer through the cover plate. This in turn leads to deformation of the bar.

SUMMARY OF THE INVENTION

The present invention provides improved needles and needle arrangement to provide improved needle embedding. According to one embodiment of the present invention, means are included for applying a tensile load at an angle of less than 90° to the needle shaft axis. The tensile load provides a force component transverse to the needle shaft longitudinal axis for pressing the shaft against the groove base and a longitudinal force component along the shaft longitudinal axis. The needle includes a projecting detent which is held against an abutment rigidly attached to the needle bar by the longitudinal force component.

In accordance with a preferred embodiment the transverse force component is at an angle relative to the shaft longitudinal axis of less than 30° and may be about 5° to 15°.

It is advantageous to apply the transverse force component at a defined needle shaft position. In a further embodiment, the needle shaft includes a projection which extends out of the needle groove and is adapted to receive the tensioning force transverse force component applied at a relatively small angle relative to the needle shaft longitudinal axis.

The needle thus arranged is exposed to cooling air circulation and is not covered over a substantial portion of its length by a synthetic film or cover plate.

In a further embodiment, the detent has an angled strike surface relative to the shaft longitudinal axis which surface cooperates with the needle bar abutment. The angled strike surface has a component in the shaft axis direction forming a key arrangement wherein the longitudinal force component of the strike surface contributes to pressing the shaft against the groove base providing enhanced positioning safety of the needle utilizing a relatively small transverse tensioning force on the needle.

In a still further embodiment, the detent and the force transferring projection are axially displaced relative to one another along the needle shaft providing a torquing action and enhanced positioning security of the needle.

In a further embodiment, the needle arrangement includes a tensioning element with an outwardly convex cross section which extends between mating corresponding support surfaces on a plurality of needles and a needle bar support surface. The arrangement further includes tensioning means, e.g., expandable means responsive to a screw for setting the tension on the needles.

In a still further embodiment, the needle bar includes a projection between the support surface on the bar and the grooves receiving the needles for providing additional bar stiffness.

As a result of lower forces, the needle bar may be hollow providing lighter and lower cost construction and facilitates heat removal.

In a preferred embodiment, the shaft includes a force transferring projection on one side and an angled detent on the other opposite side.

DESCRIPTION OF THE PREFERRED EMBODIMENTS

Figure 1:
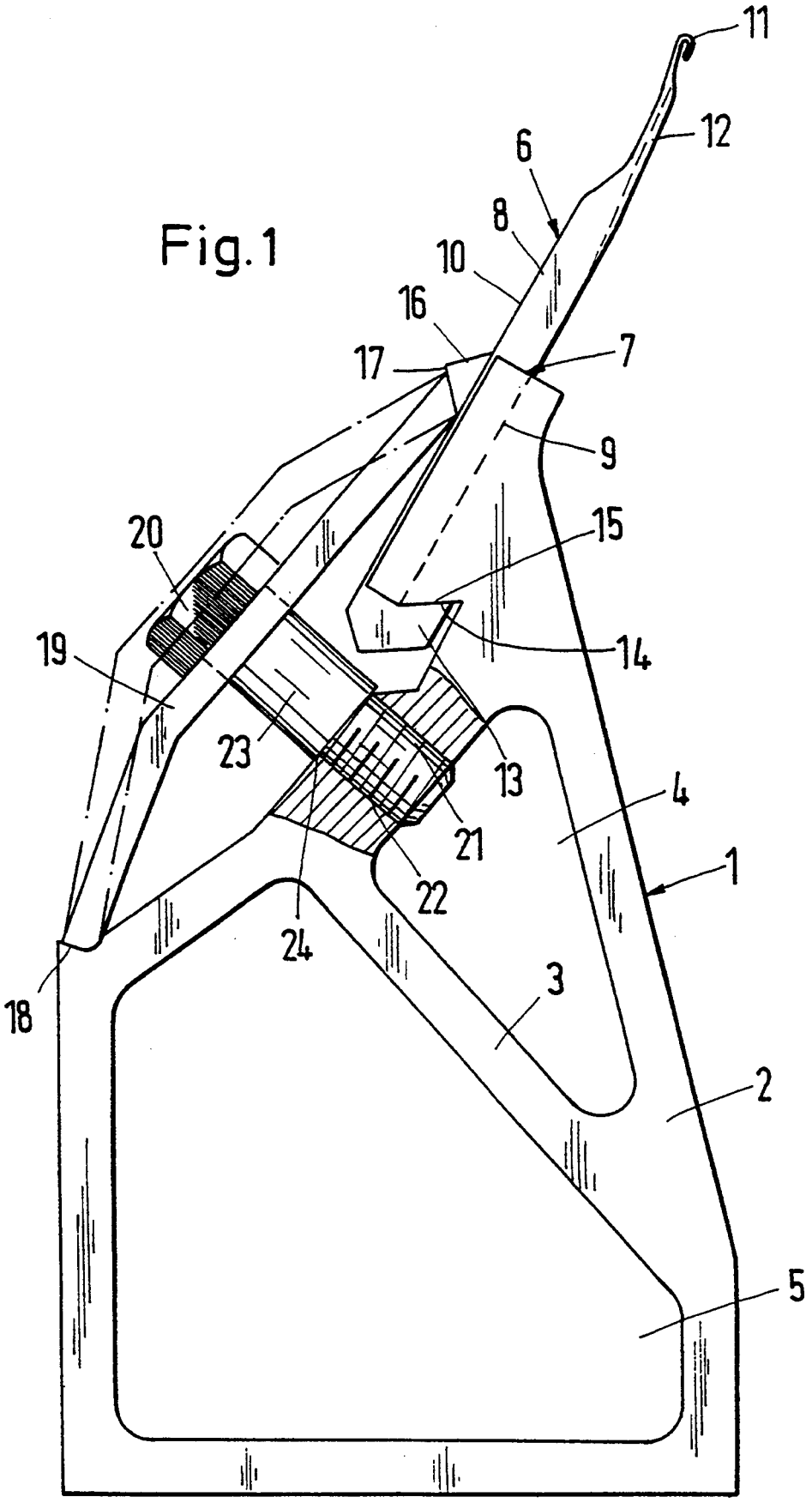
FIG. 1 is a side elevation view, partially in section, showing a needle bar including needles and holding mechanism in accordance with one embodiment of the present invention.

In FIG. 1 needle bar assembly 1 comprises a hollow profile needle bar 2 having two hollow cores 4 and 5 separated by wall 3.

Needles 6 (one being shown) are positioned in parallel corresponding grooves 7, the array of needles and grooves extending into and out of the drawing figure. Needle 6 is representative and includes a shaft 8 having a leading edge 9 lying in the base of groove 7 and a trailing edge 10 protruding from the groove 7. Needle 6 is a slider type having a hook 11 and a groove 12 in which a slider (not shown) positioned for closing the hook space, rides.

Needle 6 has projection 13 at its foot and which is provided with an angled striker surface 14 which cooperates with a corresponding abutment surface 15 on needle bar 2. Abutment surface 15 is at an acute angle with the leading edge 9 of the shaft 8. Abutment surface 15 is at such an angle relative to the longitudinal axis of the needle shaft 8 and edge 9 such that upon application of a longitudinal force on the needle 6, the force causes the leading edge 9 to be pressed against the groove 7 base.

A force transfer projection 16 is substantially at the center of the shaft 8 along its longitudinal length direction and is outside the groove 7. The projection 16 has a support surface 17. The needle bar 2 has a support surface 18. A tensioning element 19 is located between the surfaces 17 and 18. The element 19 may be tin plate and has a convex cross section outwardly extending relative to the bar 2.

A plurality of tensioning elements 19 are distributed side by side along the length of the needle bar 2 in and out of the drawing figure. Each tensioning element is tensioned by a screw 20 whose threads 21 engage threaded bore 22 of bar 2. By tightening the screw 20, the element 19 is displaced form the position shown in phantom to that shown in solid lines. This position is defined by the interaction of screw 20 with a collar 23 on the screw 20 which, when the screw is tightened, abuts surface 24 of the needle bar 2 and the element 19. This tightening of the screw 20 spreads the tensioning element transferring a force to the needle 6 via surface 17 of projection 16 and surface 18 of bar 2. This force is limited by the contact of the collar 23 with surface 24 and element 19.

Figure 2:
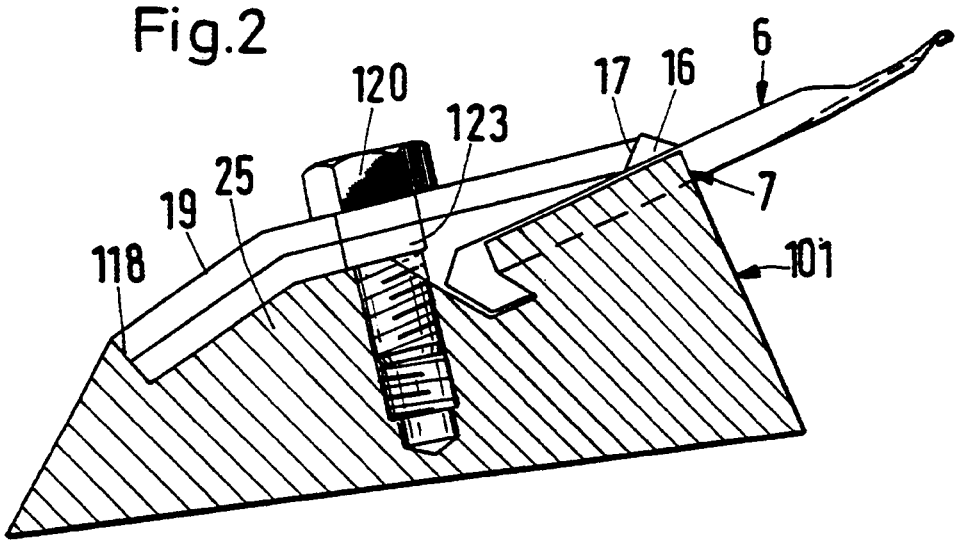
FIG. 2 is a side elevation view of a second embodiment of the present invention.

In FIG. 2, corresponding parts have the same numbers and changed parts have numbers raised by 100. The principal difference is that the needle bar 101 is not a hollow profile bar, but has a full profile (solid) and the increase of the stiffness of the cross section of the needle bar between the groove 7 and the support surface 118 is achieved by projection 25 on the bar. This permits reduction in the size (axial length) of the collar 123 of the tensioning screw 120.

Figure 3:
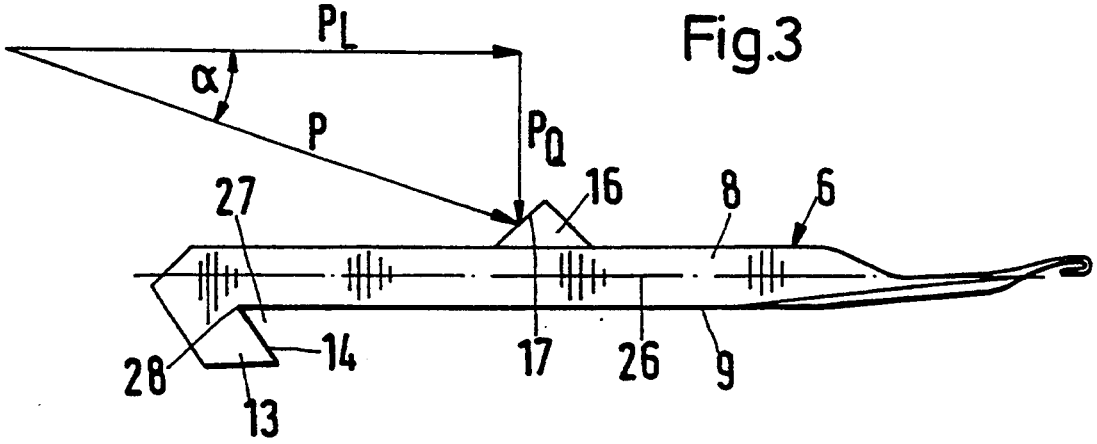
FIG. 3 is a side elevation view of a needle similar to that utilized in FIGS. 1 and 2.

In FIG. 3, needle 6, which is similar to the needles of FIGS. 1 and 2, illustrates how the force P is transferred by the tensioning element 19. This force is applied at an angle $\alpha$ to the longitudinal axis 26 of the needle 6. The force P on the needle is has a longitudinal force component $P_L$ and transverse component $P_Q$. The longitudinal force component $P_L$ ensures that the angled strike surface 14 rests against the needle bar abutment surface 15 and thus ensures a force transferring positioning of the axial position of needle 6. An interlocking key type space 27 is formed between striker surface 14 and the leading edge 9 which space and the needle bar surface 15 are configured so that the needle leading edge 9 is pressed against the groove 7 base. Since the strike surface 14 and the support surface 17 are located on opposite sides of the needle axis 26, a turning moment or torque is created about a fulcrum 28 at the junction of surface 14 and edge 9. This torque additionally presses the leading edge 9 against the groove 7 base. The transverse component P Q forces the needle into engagement with the groove 7. Since the support surface 17 is axially displaced with respect to the strike surface 14, there is also a turning moment about fulcrum 28 which supports the pressing action of the needle against the groove 7 base. As a result, a relatively small force p maintains the needle 6 securely in a defined position.

Figure 4:
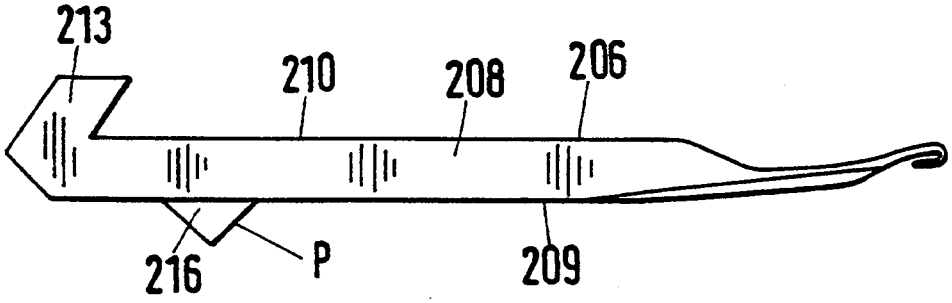
FIGS. 4–11 are side elevation views of further embodiments of the needles according to the present invention.

FIGS. 1–3 show a needle positioning in a tricot machine and FIG. 4 shows a needle 216 for a raschel machine. In such a machine the trailing edge 210 of the shaft 208 lies in the groove base. Consequently, the detent projection 213 is located on the trailing edge 210 and the force transferring projection 216 on the leading edge 209 of the needle. The tensioning force P is on the projection 216 similar to that shown in FIG. 3.

Figure 5:
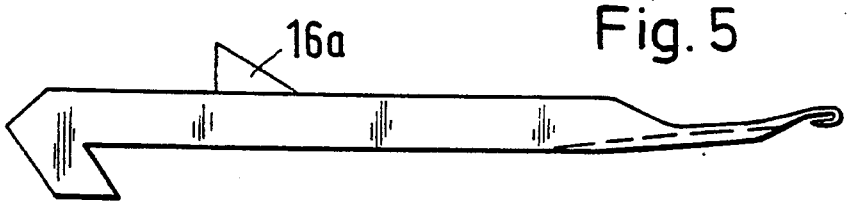
Figure 6:
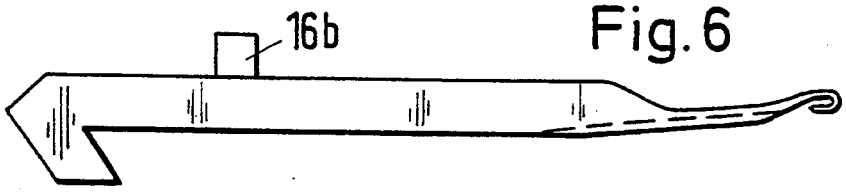
Figure 7:
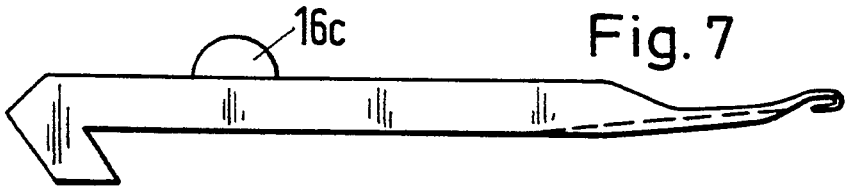

FIGS. 5, 6 and 7 show the form of the force transfer projections **16*a*, 16*b* and 16*c* respectively, and thus the nature of the support surface, may be different. While the force transfer projection is shown as an equilateral triangle in FIG. 3, the force transferring projection 16*a* in FIG. 5 is a right triangle, in FIG. 6 projection 16*b* is a quadrilateral and the projection 16*c* in FIG. 7 is semicircular. In many instances it is desirable that the support surface 17** be substantially perpendicular to the direction of the force P.

Figure 8:
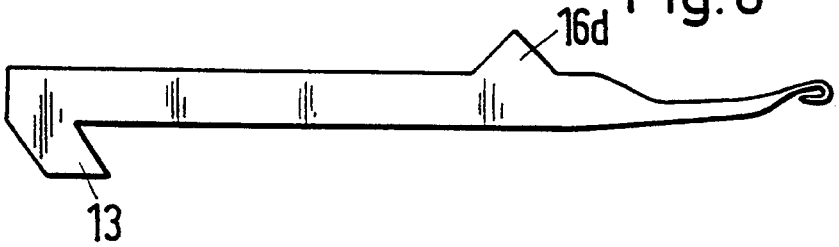

In the needle of FIG. 8, while the position of the detent 13 is maintained, the force transferring projection 16d is located substantially a greater distance from the detent 13 than in the other embodiments of FIGS. 5–7. This provides a relatively increased turning moment applied against the needle for a given transfer force magnitude.

Figure 9:
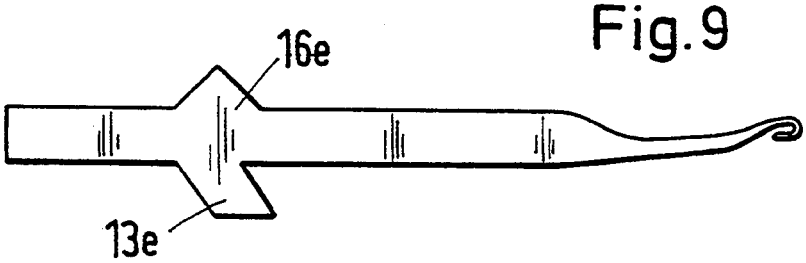

FIG. 9 illustrates an embodiment wherein the detent **13*e* and the force transferring projection 16*a*** are located in the same axial position along the needle.

Figure 10:
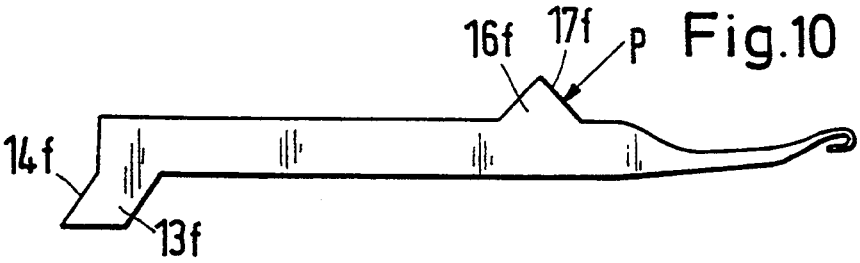
Figure 11:
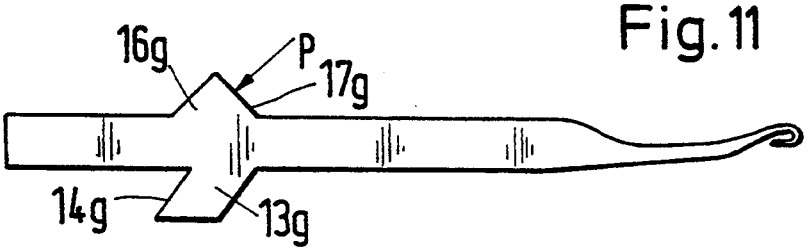

The tensioning force in the needles of FIGS. 10 and 11 operate in opposite directions to that described previously in the other embodiments. The support surfaces **17*f* and 17*g* are provided on the side of the force transferring projections 16*f* and 16*g*, respectively, facing the needle hook. In these needles,the angle of the striker surfaces 14*f* and 14*g* and the abutments 13*f* and 13*g* operate in the opposite direction to those of the preceding figures. In FIGS. 9 and 11, the groove should extend between the detent 13*e* and 13*g*** to the foot end of the needle.

The tensioning element 19 preferably is sheet metal and may extend over a plurality of needles 6 in an array. The force transfer projections **16*a*–16*c* operate the same as those shown in FIGS. 1–3. The only difference is that the front face of element 19** engaging these projections may not be flat and may be formed to different shapes to conform to the projections, e.g., by grinding and so on.

FIGS. 3, 8 and 9 show different embodiments with the force transfer projection and striker detent projection in different positions on the needle. FIGS. 10 and 11 show that the tension forces may be directed in different relative directions to the needle hook.

I claim:

1. A needle arrangement for a warp knitting machine comprising:

a needle bar having a plurality of parallel needle receiving grooves each having a base;

at least one needle having a shaft extending along an axis and received in one of said grooves;

a striker detent projection depending from the shaft facing the needle bar groove base; and tension means for pressing the shaft against the base of the one groove, said tension means including (a) a force transmitting projection secured to the shaft and which projects from said one groove, and (b) means for applying a force on the force transmitting projection on the needle shaft at an angle less than 90° to the shaft axis.

2. The needle arrangement of claim 1 wherein the angle is less than 30°.

3. The needle arrangement of claim 2 wherein the angle is between 5° and 15°.

4. The arrangement of claim 1 wherein the detent projection has a striker surface at an acute angle to the needle axis and the needle bar has an abutment surface which cooperates with the striker surface.

5. The needle arrangement of claim 1 wherein the needle has a foot, said detent projection is on the foot, the detent projection and the force transmitting projection are axially displaced, from one another along the needle shaft axis.

6. The needle arrangement of claim 1 wherein the tensioning means includes a tensioning element having a convex shape extending away from the needle and needle bar, said bar and at least one needle each having a support surface, said element abutting said bar and needle support surfaces and a tensioning screw coupled to said bar and element for adjustably spreading the element between said support surfaces to apply a settable tensioning force on said needle.

7. The needle arrangement of claim 6 including a collar coupled to the screw between the element and the bar for limiting the maximum magnitude of the tensioning force applied by said element.

8. The needle arrangement of claim 6 wherein the bar has a projection between the bar support surface and the one groove base.

9. The needle arrangement of claim 1 wherein the needle bar is hollow having at least one hollow core.

10. A needle for a needle bar used in a warp knitting machine comprising:

a shaft having a longitudinally extending axis and a needle hook on one end;

a force transferring projection on one side of the shaft; and a striker detent on the other side of the shaft having a striker surface extending at an acute angle relative to the shaft axis, the detent for engaging said needle bar, said projection being axially spaced from the striker detent in a direction toward the needle hook.

11. The needle of claim 10 wherein the projection is triangular.

12. The needle of claim 10 wherein the projection is curved.

13. A needle arrangement for a warp knitting machine comprising:

a needle bar having a plurality of parallel needle receiving grooves each having a base;

a plurality of needles each having a shaft extending along an axis and received in a different one of said grooves;

a striker detent projection depending from the shaft of each needle and facing the needle bar groove base; and tension means for pressing the shaft of each needle against the base of the one groove, said tension means including (a) a force transferring projection extending from said shaft in a direction generally opposite said striker detent projection, and (b) means coupled between the needle bar and the force transferring projection for applying a tensioning force on said force transferring projection on the needle shaft at an angle less than 90° to the shaft axis.

14. The arrangement of claim 13 wherein the detent projection is arranged such that the force on said needle torques the needle about a fulcrum point between the striker detent projection and the needle shaft against the groove base.

* * * * *